US009851096B2

(12) United States Patent
Vega et al.

(10) Patent No.: US 9,851,096 B2
(45) Date of Patent: Dec. 26, 2017

(54) STEAM GENERATOR FILM COOLING USING PRODUCED WATER

(75) Inventors: John Vega, Camarillo, CA (US); Jeffrey A. Mays, Canoga Park, CA (US)

(73) Assignee: Gas Technology Institute, Des Plaines, IL (US)

( * ) Notice: Subject to any disclaimer, the term of this patent is extended or adjusted under 35 U.S.C. 154(b) by 410 days.

(21) Appl. No.: 13/448,293

(22) Filed: Apr. 16, 2012

(65) Prior Publication Data

US 2013/0269630 A1 Oct. 17, 2013

(51) Int. Cl.

| | |
|---|---|
| ***F22B 1/02*** | (2006.01) |
| ***F22B 37/02*** | (2006.01) |
| *F28F 19/00* | (2006.01) |
| *F28C 3/08* | (2006.01) |

(52) U.S. Cl.

CPC ..... *F22B 1/02* (2013.01); *F22B 37/02* (2013.01); *F28C 3/08* (2013.01); *F28F 19/00* (2013.01)

(58) Field of Classification Search

CPC ..... F05D 2260/202; F05D 2260/232; F22B 37/107; F22B 37/108; F22B 37/54; F22B 27/16; F22B 27/165; F22B 29/02; F02M 53/043; A61H 33/063; A61M 2011/002

USPC ..... 122/39; 261/79.1, 79.2; 166/57, 59

See application file for complete search history.

(56) References Cited

U.S. PATENT DOCUMENTS 1,329,818 A * 2/1920 Wolcott ..... B01D 51/10 95/66
3,811,276 A * 5/1974 Caruel ..... F23R 3/08 60/757
4,216,002 A * 8/1980 Rosenblad ..... B01D 5/0015 159/13.3
4,385,661 A 5/1983 Fox
4,411,618 A 10/1983 Donaldson et al.
4,466,808 A * 8/1984 Koog ..... C10J 3/485 252/373
4,474,584 A * 10/1984 Koog ..... C10J 3/485 252/373
4,558,743 A * 12/1985 Ryan ..... E21B 36/02 122/31.1
4,604,988 A * 8/1986 Rao ..... B01F 5/0451 122/31.2
4,969,507 A * 11/1990 Rosenblad ..... F28B 1/00 165/111
5,123,836 A * 6/1992 Yoneda ..... F23G 5/50 110/215
6,151,887 A * 11/2000 Haidn ..... F02K 9/972 60/257
7,284,931 B2 * 10/2007 Stratford ..... F03G 7/04 166/302
7,770,646 B2 8/2010 Klassen et al.
7,780,152 B2 * 8/2010 Rao ..... E21B 43/2406 166/272.3
8,495,973 B2 * 7/2013 Poshusta ..... B01B 1/005 122/39
8,597,385 B2 * 12/2013 Corry ..... C10J 3/86 165/135
8,613,316 B2 * 12/2013 Castrogiovanni ..... E21B 36/02 166/257
9,417,010 B2 * 8/2016 Wolf ..... F28F 25/04
(Continued)

*Primary Examiner* — Gregory A Wilson
(74) *Attorney, Agent, or Firm* — Pauley Erickson & Kottis

(57) ABSTRACT

An exemplary steam generator assembly includes a wall. Produced water acts as film cooling to at least a portion of the wall.

18 Claims, 2 Drawing Sheets

(56) References Cited

U.S. PATENT DOCUMENTS

| | | | | |
|---|---|---|---|---|
| 2003/0145592 | A1* | 8/2003 | Stratford | F03G 7/04 60/641.2 |
| 2006/0053791 | A1* | 3/2006 | Prentice, III | F23G 5/006 60/645 |
| 2008/0134667 | A1* | 6/2008 | Pavia | F02K 9/64 60/267 |
| 2009/0293448 | A1* | 12/2009 | Grote | F02K 9/64 60/204 |
| 2011/0005193 | A1* | 1/2011 | Pavia | F02K 9/64 60/206 |
| 2011/0127036 | A1 | 6/2011 | Tilmont et al. | |
| 2011/0214858 | A1 | 9/2011 | Castrogiovanni et al. | |
| 2012/0060464 | A1* | 3/2012 | Grote | F02K 9/64 60/206 |
| 2014/0190698 | A1* | 7/2014 | Mays | E21B 43/24 166/303 |

* cited by examiner

STEAM GENERATOR FILM COOLING USING PRODUCED WATER

BACKGROUND

This disclosure relates generally to using produced water in a steam generator to film cool the steam generator.

Water separated from oil is often referred to as produced water. Other sources of produced water are possible. That is, produced water is not exclusively a byproduct of oil refining. Produced water is often characterized as untreated water having a high mineral content.

SUMMARY

A steam generator assembly according to an exemplary aspect of the present disclosure includes, among other things, a wall. Produced water acts as film cooling to at least a portion of the wall.

In a further non-limiting embodiment of the foregoing steam generator assembly, the produced water may be untreated water.

In a further non-limiting embodiment of any of the foregoing steam generator assemblies, the produced water may be water that has been separated from oil.

In a further non-limiting embodiment of any of the foregoing steam generator assemblies, the wall may provide a cylindrical combustion chamber.

In a further non-limiting embodiment of any of the foregoing steam generator assemblies, the produced water may comprise a film of produced water extending across a surface of the wall.

In a further non-limiting embodiment of any of the foregoing steam generator assemblies, the steam generator may vaporize the produced water to generate steam.

In a further non-limiting embodiment of any of the foregoing steam generator assemblies, the produced water is introduced such that the produced water separates the portion of the wall from combustion products during operation of the steam generator.

In a further non-limiting embodiment of any of the foregoing steam generator assemblies, the produced water and the combustion products may be held in a common chamber.

In a further non-limiting embodiment of any of the foregoing steam generator assemblies, the produced water and the combustion products may be in direct contact.

In a further non-limiting embodiment of any of the foregoing steam generator assemblies, the wall is configured such that the produced water film cooling the wall limits scale buildup on the wall.

A steam generator assembly according to another exemplary aspect of the present disclosure includes, among other things, a combustor wall providing at least a portion of a combustion chamber, and an inlet that delivers produced water to the combustion chamber. The produced water provides film cooling to the combustor wall.

In a further non-limiting embodiment of the foregoing steam generator assembly, a baffle may direct a flow of produced water along a surface of the combustor wall facing the combustion chamber.

In a further non-limiting embodiment of any of the foregoing steam generator assemblies, the steam may be mixed with products of combustion.

In a further non-limiting embodiment of any of the foregoing steam generator assemblies, combustion within the combustion chamber vaporizes the produced water to form steam.

In a further non-limiting embodiment of any of the foregoing steam generator assemblies, the combustion chamber is configured such that the produced water film cooling the combustor wall limits scale adhering to the combustion wall.

A steam generator operating method according to another exemplary aspect of the present disclosure includes, among other things, introducing produced water into a combustion chamber of a steam generator, and film cooling a wall of the combustion chamber using the produced water.

In a further non-limiting embodiment of the foregoing steam generator operating method, the method may include limiting scaling buildup on the wall using the produced water.

In a further non-limiting embodiment of the foregoing steam generator operating method, the produced water is water that has been separated from oil.

DESCRIPTION OF THE FIGURES

The various features and advantages of the disclosed examples will become apparent to those skilled in the art from the detailed description. The figures that accompany the detailed description can be briefly described as follows.

DETAILED DESCRIPTION

Figure 1:
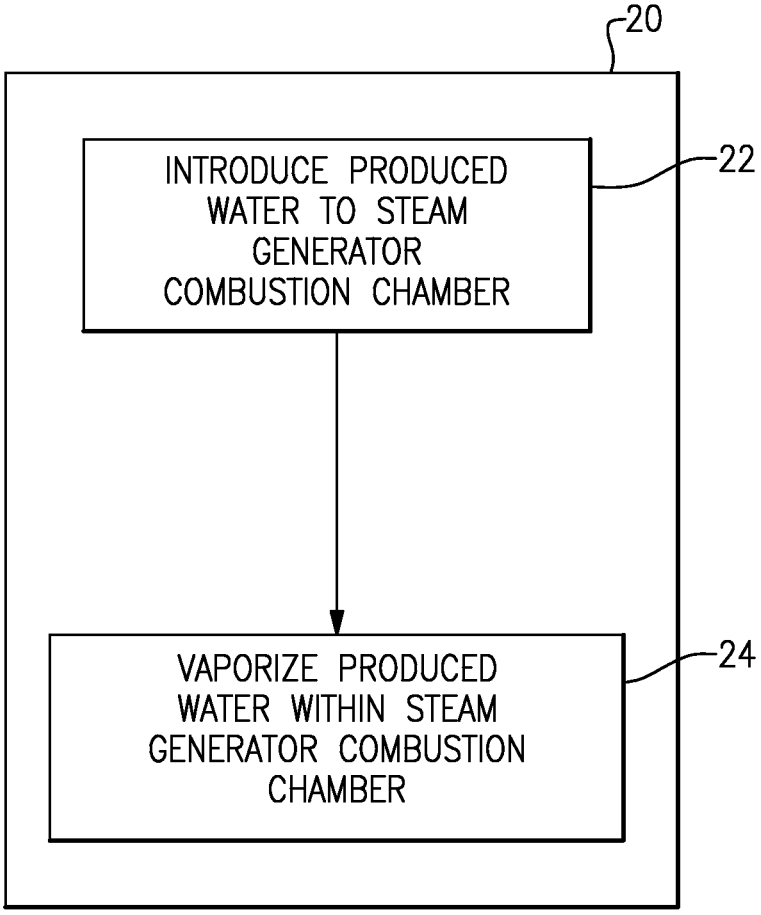
FIG. 1 illustrates an example method for operating a steam generator.

FIG. 1 illustrates an example method 20 for operating a steam generator. In this example, the method 20 generally includes steps 22 and 24, although it is to be understood that each of the steps 22 and 24 may include any number of sub-steps in order to carry out or facilitate the primary steps 22 and 24. In the example shown, step 22 includes the action of introducing produced water to a combustion chamber of a steam generator. The second step 24 includes the action of heating the produced water until the water is vaporized. The vaporized produced water exits from the combustion chamber as steam.

Produced water is generally considered water that has been separated from oil and not been treated. Produced water may have a higher hardness than treated water and may contain impurities.

Figure 2:
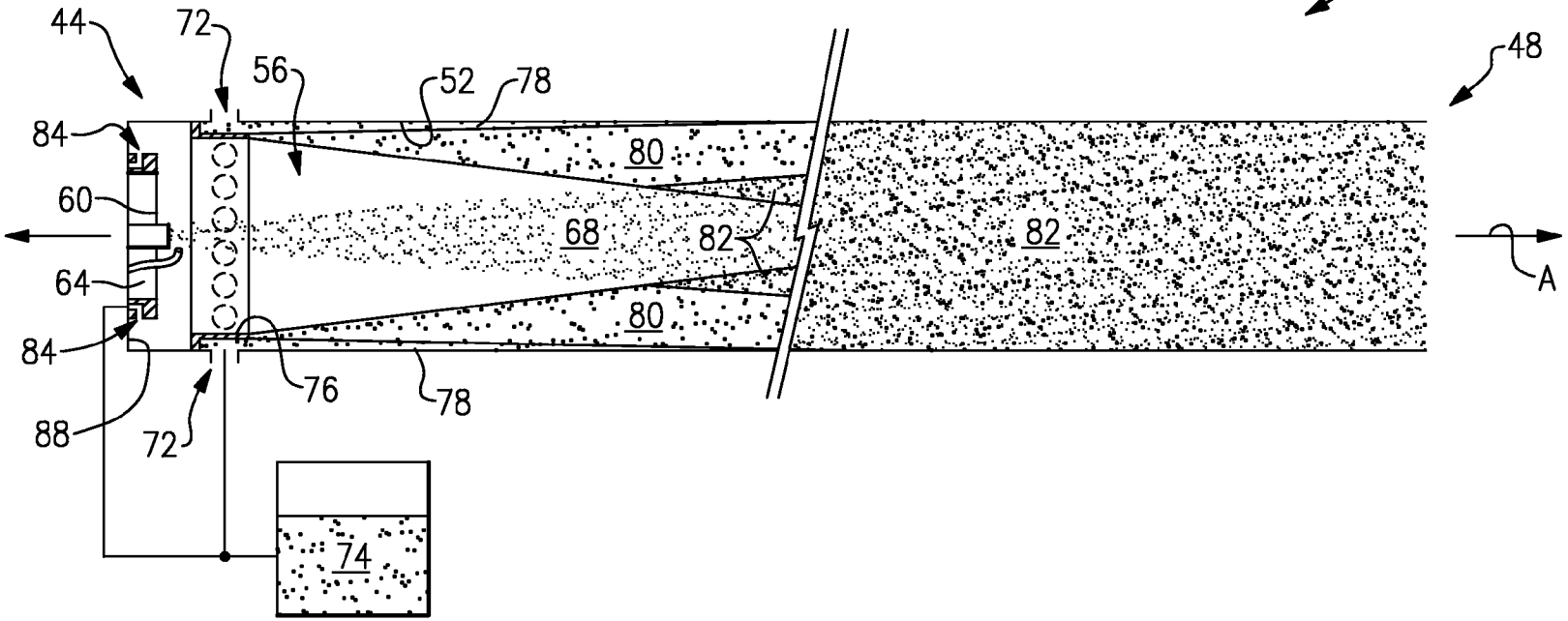
FIG. 2 shows a cross-sectional view of an example steam generator assembly.

The method 20 will be further described with reference to FIG. 2, which shows an example steam generator assembly 40 for carrying out the method 20. It is to be understood that the disclosed steam generator 40 is only an example and that the steam generator 40 can be varied in accordance with the method 20.

The example steam generator 40 is generally cylindrical and extends along an axis A from a first end 44 to an opposing, second end 48. The steam generator 40 includes a combustor wall 52 having a surface facing inwardly toward the axis A. The combustor wall 52 provides a combustion chamber 56.

In one non-limiting example, the steam generator 40 is from 7 to 21 feet (2.1-6.4 meters) long and about 4 inches (10.2 centimeters) in diameter.

An injector 60 at the first end 44 of the steam generator 40 delivers a mixture of fuel and oxidizer to the combustion chamber 56 near the axis A. An igniter 64 provides a flame that causes the mixture to combust. A combustion zone 68 schematically represents how the products of combustion propagate from the first end 44 toward the second end 48. As shown, the products of combustion tend to fan radially outward when moving toward the second end 48.

Water from a produced water supply 74 is delivered to the combustion chamber 56 through a plurality of inlets 72 established within the combustor wall 52. In this example, the inlets 72 direct the water through the combustor wall 52 in a radial direction. The water then contacts a baffle 76, which redirects the water to move in an axial direction along the combustor wall 52. The inlets 72 are arranged circumferentially about the axis A. Water from the inlets 72 thus circumferentially surrounds the products of combustion when water moves through all the inlets 72.

The products of combustion are very hot, especially near the first end 44 of the steam generator 40. Notably, the products of combustion do not directly contact the combustor wall 52 in the area of the steam generator 40 due to the water from the inlets 72 separating the products of combustion from the combustor wall 52. The water from the inlets 72 essentially insulates this portion of the combustor wall 52 from some of the thermal energy associated with the products of combustion.

More specifically, in this example, the water from the inlets 72 acts as film cooling to the combustor wall 52. Film cooling the combustor wall 52 helps prevent scaling buildup on the combustor wall 52 from the evaporation of the water. Film cooling the combustor wall 52 limits or prevents scale from adhering and building up on the wall, which enables the steam generator 40 to utilize water from the produced water supply 74 rather than water that is not produced water. Instead of adhering to the combustor wall 52, solids from the produced water are combusted or exit the steam generator 40 with the products of combustion and the steam. The solids exit as particulate matter.

Insulating the combustor wall 52 also prevents the combustor wall 52 from contacting the concentrated carbonaceous gases associated with the products of combustion near the first end 44.

A liquid film cooling zone 78 generally represents the produced water that is providing film cooling. As the products of combustion and the water from the inlets 72 move toward the second end 48, increasing amounts of the liquid water vaporize due to the thermal energy of the products of combustion. A vaporized film cooling zone 80 generally represents this vaporized water.

During operation, the products of combustion tend to expand radially outward. This tendency helps hold the liquid film cooling zone 78 and the vaporized film cooling zone 80 near the combustor wall 52.

During operation, the products of combustion also move toward the second end 48. This movement causes the liquid water in the liquid film cooling zone 78 and the vaporized water in the vaporized film cooling zone 80 to move toward the second end 48.

As the products of combustion and the water from the inlets 72 move toward the second end 48, the products of combustion and the water from the inlets 72 become mixed. A mixture zone 82 generally represents this mixture of the product of combustion and the vaporized water. The mixture is expelled from the steam generator 40 as steam. In another example, the mixture is condensed and used as clean (not produced) water.

The example steam generator 40 includes an array of nozzles 84 distributed circumferentially about the axis near the injector 60. The array of nozzles 84 direct sprays of water radially outward toward the combustor wall 52.

In this example, the nozzles 84 receive water from the produced water supply 74. The nozzles 84 are arranged close enough to each other such that the sprays from circumferentially adjacent nozzles 84 overlap. This arrangement provides a sheet of water extending radially from the nozzles 84 toward the combustor wall 52. The sheet of water limits thermal energy contacting an end wall 88 of the steam generator 40, and other areas of the steam generator 40 near the first end 44.

Features of the disclosed examples include directly, rather than indirectly, heating water in a steam generator combustor to produce steam. The water is produced water. The produced water film cools the combustor.

The preceding description is exemplary rather than limiting in nature. Variations and modifications to the disclosed examples may become apparent to those skilled in the art that do not necessarily depart from the essence of this disclosure. Thus, the scope of legal protection given to this disclosure can only be determined by studying the following claims.

We claim:

1. A steam generator assembly, comprising:

a combustor having a wall providing a combustion chamber, wherein the combustion chamber is axially extending and wherein within the combustion chamber a produced water acts as film cooling to at least a portion of a combustion chamber facing surface of the wall, wherein the produced water is an untreated water having a high mineral content and wherein the produced water comprises a film of produced water extending within the combustion chamber across at least a portion of the combustion chamber facing surface of the wall;

an igniter assembly for combusting a mixture of fuel and oxidizer, the igniter assembly disposed at a first axial end of the combustion chamber; and an array of nozzles circumferentially distributed about the axis adjacent the igniter assembly to direct sprays of produced water radially outward toward the combustor wall.

2. The steam generator assembly of claim 1, wherein the wall provides a cylindrical combustion chamber.

3. The steam generator assembly of claim 1, wherein the steam generator vaporizes the produced water to generate steam.

4. The steam generator assembly of claim 1, wherein the produced water is introduced such that the produced water separates the portion of the wall from combustion products during operation of the steam generator.

5. The steam generator assembly of claim 4, wherein the produced water and the combustion products are present in the combustion chamber.

6. The steam generator assembly of claim 4, wherein the produced water acting as film cooling and the combustion products are in direct contact in the combustion chamber.

7. The steam generator assembly of claim 1, wherein the wall is configured such that the produced water film cooling the combustion chamber facing surface of the wall limits scale buildup on the wall.

8. A steam generator assembly, comprising:

a combustor wall defining at least a portion of an axially extending combustion chamber;

an igniter assembly for combusting a mixture of fuel and oxidizer, the igniter assembly disposed at a first axial end of the combustion chamber;

an array of nozzles circumferentially distributed about the axis adjacent the igniter assembly to direct sprays of produced water radially outward toward the combustor wall; and an inlet that delivers produced water to the combustion chamber, the produced water providing film cooling within the combustion chamber to at least a portion of a combustion chamber facing surface of the combustor wall and during operation of the steam generator assembly the produced water is in direct contact with and separates combustion products from the at least a portion of the combustion chamber facing surface of the wall, wherein the produced water is an untreated water having a high mineral content.

9. The steam generator assembly of claim 8, wherein the steam is mixed with products of combustion.

10. The steam generator assembly of claim 8, wherein combustion within the combustion chamber vaporizes the produced water to form steam.

11. The steam generator assembly of claim 8, wherein the combustion chamber is configured such that the produced water film cooling the combustor wall limits scale adhering to the combustor wall.

12. The steam generator assembly of claim 8, wherein:

the combustor wall extends from the first end to an opposing second end to at least in part define the combustion chamber;

the combustion products propagate from the first end to the second end; and the film cooling begins adjacent the first end.

13. A steam generator assembly comprising:

a combustor wall defining at least a portion of a combustion chamber;

an inlet that delivers produced water to the combustion chamber, the produced water providing film cooling within the combustion chamber to at least a portion of a combustion chamber facing surface of the combustor wall and during operation of the steam generator assembly the produced water is in direct contact with and separates combustion products from the at least a portion of the combustion chamber facing surface of the wall, wherein the produced water is an untreated water having a high mineral content; and including a baffle that directs a flow of produced water along at least a portion of the combustion chamber facing surface of the combustor wall.

14. The steam generator assembly of claim 13, wherein the steam is mixed with products of combustion.

15. The steam generator assembly of claim 13, wherein combustion within the combustion chamber vaporizes the produced water to form steam.

16. The steam generator assembly of claim 13, wherein the combustion chamber is configured such that the produced water film cooling the combustor wall limits scale adhering to the combustor wall.

17. A steam generator assembly comprising:

a combustor chamber defined at least in part by a wall, the wall having an inner surface within the combustion chamber, wherein a produced water acts as film cooling to at least a portion of the wall inner surface within the combustion chamber, wherein the produced water is an untreated water having a high mineral content; and including a baffle that directs a flow of produced water along at least a portion of the combustion chamber facing surface of the combustor wall.

18. The steam generator assembly of claim 17 wherein the produced water directly contacts combustion products and separates the portion of the wall inner surface from the combustion products during operation of the steam generator assembly.

* * * * *